US007836724B2

(12) United States Patent
Gotoh et al.

(10) Patent No.: US 7,836,724 B2
(45) Date of Patent: Nov. 23, 2010

(54) SCREW COMPRESSOR AND FREEZER

(75) Inventors: Nozomi Gotoh, Settsu (JP); Masaaki Izumi, Settsu (JP)

(73) Assignee: Daikin Industries, Ltd., Osaka (JP)

( * ) Notice: Subject to any disclaimer, the term of this patent is extended or adjusted under 35 U.S.C. 154(b) by 143 days.

(21) Appl. No.: 10/570,880

(22) PCT Filed: Aug. 17, 2004

(86) PCT No.: PCT/JP2004/011771

§ 371 (c)(1),
(2), (4) Date: Mar. 7, 2006

(87) PCT Pub. No.: WO2005/026554

PCT Pub. Date: Mar. 24, 2005

(65) Prior Publication Data

US 2006/0285966 A1 Dec. 21, 2006

(30) Foreign Application Priority Data

Sep. 9, 2003 (JP) ..... 2003-316469

(51) Int. Cl.
*F25B 1/00* (2006.01)

(52) U.S. Cl. ..... 62/498; 62/513

(58) Field of Classification Search ..... 62/498, 62/513, 97, 197, 113, 228.1; 415/72; 417/197, 417/310, 83, 440; 418/15, 57, 55.1, 55.5, 418/55.6

See application file for complete search history.

(56) References Cited

U.S. PATENT DOCUMENTS 3,577,742 A * 5/1971 Kocher ..... 62/199
4,062,199 A * 12/1977 Kasahara et al. ..... 62/197
4,475,360 A * 10/1984 Suefuji et al. ..... 62/324.1
4,832,068 A * 5/1989 Wendschlag et al. ..... 62/197
5,200,872 A * 4/1993 D'Entremont et al. ..... 361/25
5,341,658 A * 8/1994 Roach et al. ..... 62/468
5,431,025 A * 7/1995 Oltman et al. ..... 62/84
5,469,716 A * 11/1995 Bass et al. ..... 62/505
5,575,157 A * 11/1996 Harold ..... 62/115
5,996,364 A * 12/1999 Lifson et al. ..... 62/196.1
6,167,722 B1 * 1/2001 Kasezawa et al. ..... 62/513
6,474,087 B1 * 11/2002 Lifson ..... 62/199
6,571,576 B1 * 6/2003 Lifson et al. ..... 62/513
6,574,987 B2 * 6/2003 Takeuchi et al. ..... 62/500
7,278,832 B2 * 10/2007 Lifson et al. ..... 417/310

FOREIGN PATENT DOCUMENTS

EP 1132621 A1 * 9/2001
JP 55-100079 12/1977
JP 60-35169 3/1985
JP 61-285352 12/1986
JP 11-248264 9/1999

* cited by examiner

*Primary Examiner*—Mohammad M Ali
(74) *Attorney, Agent, or Firm*—Global IP Counselors

(57) ABSTRACT

A screw compressor has a screw rotor and a cylinder having an economizer port. The economizer port communicates with a compression chamber formed between the screw rotor and the cylinder. The economizer port is configured and arranged to jet a refrigerant into the compression chamber before closing the compression chamber. Accordingly, the economizer is in communication with the compression chamber while the inner pressure of the compression chamber is low.

6 Claims, 6 Drawing Sheets

SCREW COMPRESSOR AND FREEZER

CROSS-REFERENCE TO RELATED APPLICATIONS

This U.S. National stage application claims priority under 35 U.S.C. §119(a) to Japanese Patent Application No. 2003-316469 filed in Japan on Sep. 9, 2003, the entire contents of which are hereby incorporated herein by reference.

TECHNICAL FIELD

The present invention relates to, for example, a screw compressor for compressing refrigerant and a freezer using the screw compressor.

BACKGROUND ART

A conventional screw compressor is composed of, as shown in a developed view of FIG. 7, a screw rotor 40, a pair of gate rotors 44 (only one rotor is shown) engaging with the screw rotor 40 interposed therebetween, and a cylinder 41 for housing the screw rotor 40 in a rotatable state (see Patent Document JP 11-248264 A). The screw rotor 40 rotates in an arrow A direction.

A compression chamber 43 is formed between the screw rotor 40 and the cylinder 41. More specifically, the compression chamber 43 is tightly closed by engagement between a screw groove 40*a* of the screw rotor 40 and a tooth section 44*a* of the gate rotor 44.

The cylinder 41 has an economizer port 42 for jetting a refrigerant into the compression chamber 43.

The economizer port 42 does not yet communicate with the compression chamber 43 immediately after closing the compression chamber 43. The economizer port 42 opens the compression chamber 43 after starting to compress the refrigerant, as shown by a dotted line in FIG. 2.

In the conventional screw compressor, the economizer port 42 communicates with the compression chamber 43 when the inner pressure of the compression chamber 43 is high after starting to compress the refrigerant. Therefore, a pressure in the economizer port 42, which communicates with the compression chamber 43, is also high (e.g., the average pressure in the economizer port 42 becomes about 7 kg/cm$^2$, as shown by the dotted line in FIG. 2). This decreases the amount of the refrigerant jetted from the economizer port 42. Consequently, it becomes impossible to fulfill a cooling effect by the refrigerant and to make best use of the economizer effect.

SUMMARY OF INVENTION

Subjects to be Solved by the Invention

It is an object of the present invention to provide a screw compressor making the best use of economizer effect obtained by increasing the amount of a refrigerant jetted from an economizer port to enhance a cooling effect, and a freezer using the screw compressor.

Means for Solving the Subjects

In order to achieve the above-mentioned object, the present invention provides a screw compressor, comprising:

a screw rotor;

a cylinder for housing the screw rotor; and an economizer port provided in the cylinder and communicating with a compression chamber formed between the screw rotor and an inner face of the cylinder, wherein the refrigerant is jetted into the compression chamber before closing the compression chamber.

According to the screw compressor in the present invention, before the compression chamber is closed, the economizer port communicates with the compression chamber formed between the screw rotor and the inner face of the cylinder. Therefore, it is possible for the economizer to communicate with the compression chamber when the inner pressure of the compression chamber is low before starting to compress the refrigerant. This makes it possible to increase the amount of the (vapor and liquid two-phase) refrigerant jetted form the economizer port. Therefore, the cooling effect is obtained by the refrigerant from the economizer port, which makes it possible to make the best use of the economizer effect and enhance the capacity.

In one embodiment of the present invention, the compression chamber is closed before the refrigerant jetted from the economizer port leaks to a low pressure side of the screw rotor.

According to the screw compressor of this embodiment, the refrigerant jetted from the economizer port does not leak to the low pressure side of the screw rotor. Thereby, the suction amount of the refrigerant on the low pressure side of the screw rotor is prevented from decreasing and therefore deteriorating the efficiency.

In one embodiment of the present invention, the economizer port has a shape along a length direction of a vane of the screw rotor.

According to the embodiment, it is possible to swiftly open and close the economizer port and therefore to further decrease in the inner pressure of the economizer port because the economizer port has a shape along the length direction of a vane of the screw rotor. It is also possible to increase the opening area of the economizer port. This allows increase in the amount of the refrigerant jetted from the economizer port.

In one embodiment of the present invention, a width of the vane of the screw rotor becomes gradually larger from a central section of the screw rotor toward at least one end side, and a width of the economizer port in an axis direction of the screw rotor becomes larger toward the end side where the width of the vane is larger.

According to the screw compressor in the embodiment, the width of the economizer port becomes larger toward the end side where the width of the vane is larger, which makes it possible to open and close the entire length of the economizer port at the same timing. Thereby, the economizer port is more swiftly opened and closed, which achieves further enhancement of the capacity.

In one embodiment of the present invention, the economizer port is closed by the vane.

According to the screw compressor in the embodiment, the economizer port is closed by the vane, so that the adjacent compression chambers do not communicate with each other through the economizer port. This results in enhancement of the compression efficiency.

The present invention also provides a freezer, comprising:

the screw compressor (1) according to claim 1;

a condenser (2);

an expansion section (3); and an evaporator (4), wherein the screw compressor (1), the condenser (2), the expansion section (3) and the evaporator (4) are connected in sequence, further comprising:

a sidestream path (31) diverging from a mainstream path (30) between the condenser (2) and the expansion section (3), and communicating with the economizer port (12);

a supercooling expansion section (32) provided on the sidestream path (31); and a supercooling heat exchanger (33) for executing heat exchange between a refrigerant on an outlet side of the supercooling expansion section (32) and a refrigerant in the mainstream path (30).

According to the freezer in the present invention, the presence of the screw compressor in the present invention increases the amount of the refrigerant jetted from the sidestream path (the supercooling heat exchanger), which makes it possible to enhance the efficiency of the supercooling heat exchanger. Thus, it is possible to increase the degree of liquid supercooling (SC) of the refrigerant immediately before the expansion section, and therefore to enhance the refrigeration capacity. Moreover, reduction in product size and cost can be achieved by downsizing of the supercooling heat exchanger.

EFFECTS OF INVENTION

According to the screw compressor in the present invention, the economizer port communicates with the compression chamber before being closed, which enables the economizer port to communicate with the compression chamber when the inner pressure of the compression chamber is low. Consequently, it is possible to increase the amount of the refrigerant jetted from the economizer port and to obtain the cooling effect by the refrigerant.

According to the screw compressor in one embodiment, the refrigerant jetted from the economizer port does not leak to the lower pressure side of the screw rotor. This prevents the suction amount of the refrigerant on the low pressure side of the screw rotor from decreasing and therefore deteriorating the efficiency.

According to the screw compressor in one embodiment, the economizer port has a shape along the length direction of the vane of the screw rotor, which makes it possible to quicken opening and closing of the economizer port and decrease the inner pressure of the economizer port. It is also possible to increase the opening area of the economizer port and increase the amount of refrigerant from the economizer port.

According to the screw compressor in one embodiment, the width of the economizer port becomes larger toward the end side where the width of the vane is larger, which makes it possible to open and close the entire length of the economizer port at the same timing. Therefore, faster opening and closing of the economizer port is possible, which achieves further enhancement of the capacity.

According to the screw compressor in one embodiment, the economizer port is closed by the vane, so that the adjacent compression chambers do not communicate with each other through the economizer port, resulting in enhancement of the compression efficiency.

According to the freezer in the present invention, the screw compressor in the present invention makes it possible to increase the amount of the refrigerant jetted from the sidestream path (the supercooling heat exchanger), which results enhancement in the efficiency of the supercooling heat exchanger.

DETAILED DESCRIPTION OF THE INVENTION

Embodiments of the invention will now be described with reference to the accompanying drawings.

First Embodiment

Figure 1:
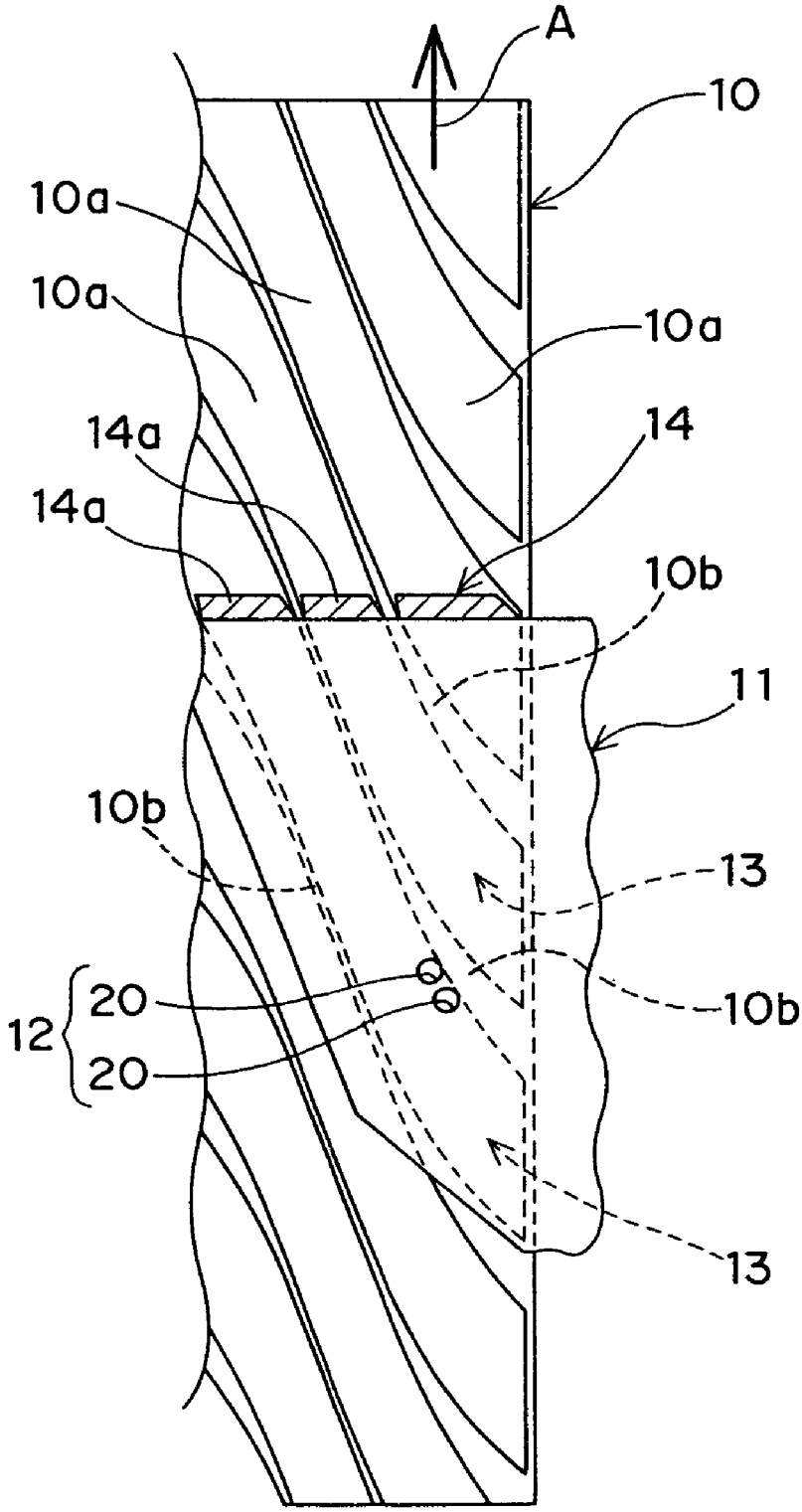
FIG. 1 is a simplified plane development view showing a screw compressor in one embodiment of the present invention.

FIG. 1 shows a simplified plane development view of a screw compressor according to one embodiment of the present invention. The screw compressor, which is a so-called single screw compressor, is composed of a screw rotor 10, a pair of gate rotors 14 (only one rotor is shown) engaging with the screw rotor 10 interposed therebetween, and a cylinder 11 for housing the screw rotor 10 in a rotatable state. The screw rotor 10 rotates in an arrow A direction.

A compression chamber 13 is formed between the screw rotor 10 and the inner face of the cylinder 11. More specifically, the compression chamber 13 is tightly closed by engagement between a screw groove 10*a* of the screw rotor 10 and a tooth section 14*a* of the gate rotor 14.

The cylinder 11 has an economizer port 12 for jetting a refrigerant to the compression chamber 13.

The economizer port 12 communicates with the compression chamber 13 before the compression chamber 13 is closed. In other words, the economizer port 12 communicates with the screw groove 10*a* before the start of compressing a refrigerant in the screw groove 10*a*. Herein, the tightly closed state of the compression chamber 13 refers to the state in which the screw groove 10*a* is closed with the tooth section 14*a* to prevent the refrigerant from leaking.

According to the thus-structured screw compressor, the economizer port 12 communicates with the compression chamber 13 before the compression chamber 13 is closed. Therefore, The economizer port 12 communicates with the compression chamber 13 when the inner pressure of the compression chamber 13 is low before compression of the refrigerant has not yet started. Thereby, the inner pressure of the economizer port 12 is decreased to the utmost.

Figure 2:
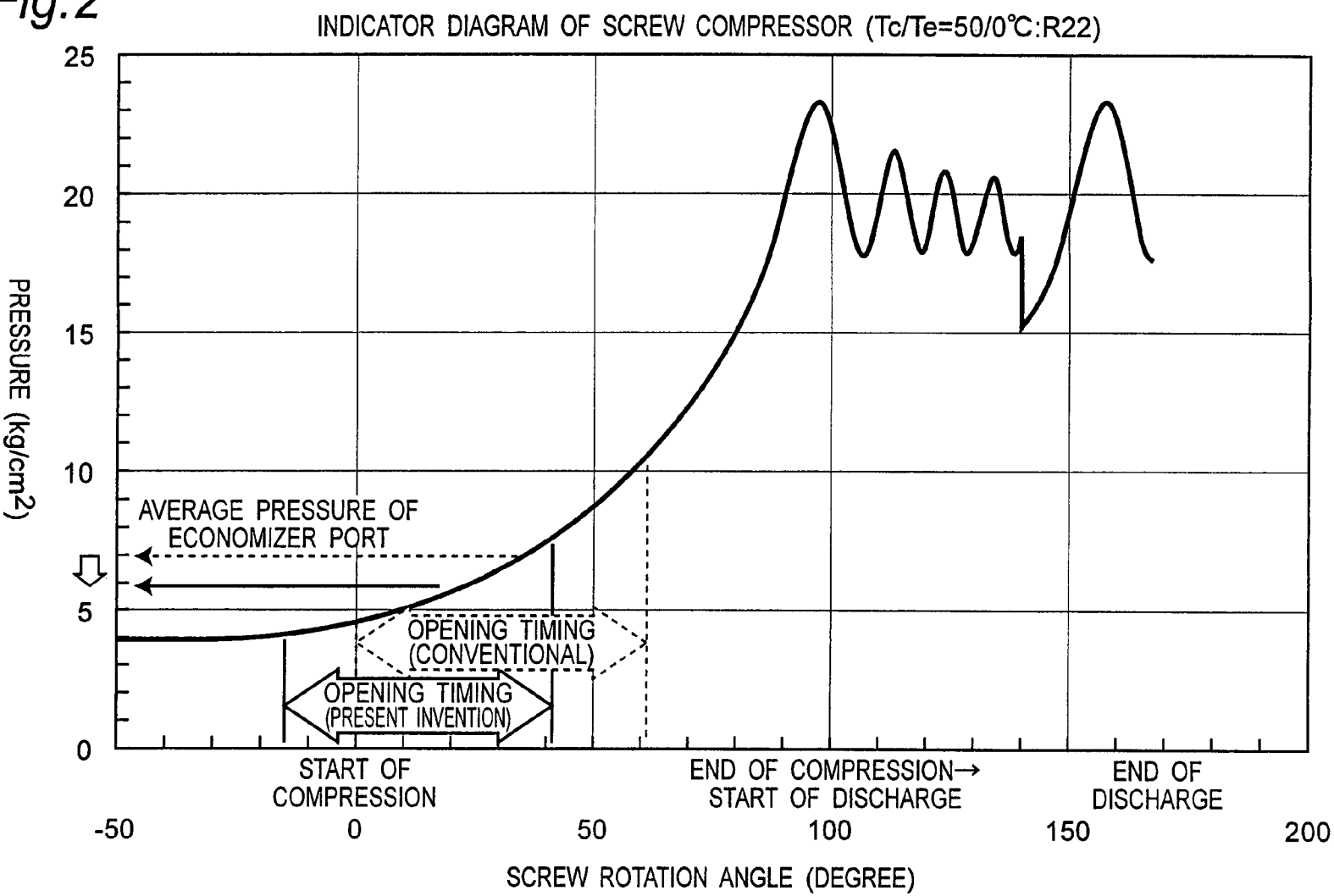
FIG. 2 is a screw compressor indicator diagram showing the comparison between a screw compressor in the present invention and a conventional screw compressor.

Particularly, as shown by a solid line in a screw compressor indicator diagram in FIG. 2, the economizer port 12 is opened before the compressing operation starts in the compression chamber 13 and is earlier closed. In short, the opening timing of the economizer port 12 is set to be the timing at which the inner pressure of the compression chamber 13 is lower than that in the conventional example shown by a dotted line. This makes it possible to decrease the average pressure of the economizer port 12 to about 6 kg/cm$^2$.

Thus, the amount of the refrigerant jetted from the economizer port 12 can be increased, and therefore the cooling effect by the refrigerant from the economizer port 12 can be fulfilled.

In this case, the compression chamber 13 is closed before the refrigerant jetted from the economizer port 12 starts to leak to the low pressure side of the screw rotor 10. In other words, the opening timing of the economizer port 12 is set to be a threshold timing, at which the refrigerant from the economizer port 12 will not leak to the low pressure side of the screw rotor 10 before the start of compression in the compression chamber 13 even if the economizer port 12 has opened in advance. This timing is determined by elements such as flow velocity of the refrigerant.

Thereby, deterioration of efficiency due to decrease in the amount of the incoming refrigerant from the low pressure side of the screw rotor 10 is prevented.

The economizer port 12 should preferably be fully opened to the compression chamber 13 by the start of the compressing operation of the compression chamber.

As shown in FIG. 1, the economizer ports 12 are formed along the length direction of a vane lob of the screw rotor 10. More specifically, the economizer port 12 is composed of two holes 20, 20, which are placed along the length direction of the vane 10*b*.

The width of the vane 10*b* becomes gradually larger from a central section of the screw rotor 10 toward at least one (high pressure side) of end sides. It is to be noted that the right-hand side in the drawing is a discharge-side end of the screw rotor 10.

This structure allows swift opening and closing of the economizer port 12, and therefore allows further decrease in the inner pressure of the economizer port 12. This structure also allows the opening area of the economizer port 12 to be increased, and therefore allows the amount of the refrigerant jetted from the economizer port 12 to be increased.

Moreover, the economizer port 12 is closed by the vane 10*b*. Therefore, it is impossible for the adjacent compression chambers 13, 13 to communicate with each other via the economizer port 12, which enhances compression efficiency.

Figure 3:
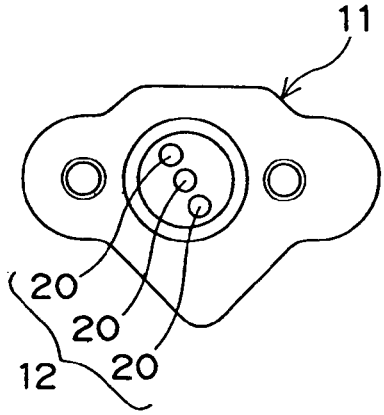
FIG. 3 is plane view showing an economizer port in another embodiment.

The number of the holes may be three as shown in FIG. 3 or may be four or more. Moreover, though unshown, the economizer port 12 may be composed of one long hole.

Second Embodiment

Figure 4A:
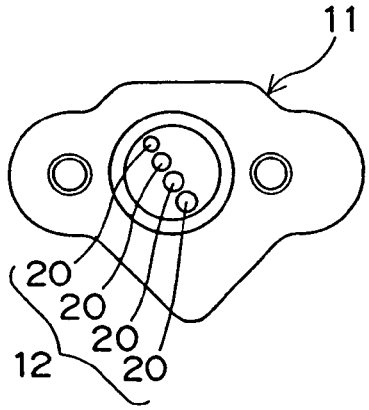
FIG. 4A is a plane view showing an economizer port in still another embodiment.
Figure 4B:
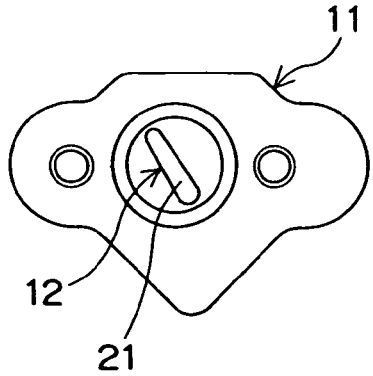
FIG. 4B is a is plane view showing an economizer port in yet another embodiment.

Next, a screw compressor according to another embodiment of the present invention is shown in FIG. 4A and FIG. 4B. In the first embodiment, the width of the economizer port 12 in axis direction of the screw rotor 10 is uniform. On the other hand, the width of the economizer port 12 in FIG. 4A and FIG. 4B is larger toward the end side where the width of the vane 10*b* is larger.

Specifically, as shown in FIG. 4A, the size of four holes 20 constituting the economizer port 12 becomes larger in sequence toward the end side of the screw rotor 10.

Moreover, as shown in FIG. 4B, the size of the long hole 21 constituting the economizer port 12 becomes gradually larger toward the end side of the screw rotor 10. More particularly, the long hole 21 has deformation of an elliptic shape.

Thus, the economizer port 12 can be opened and closed over the entire length thereof at the same timing, which allows faster opening and closing of the economizer port, thereby achieving further enhancement of the capacity.

Third Embodiment

Figure 5:
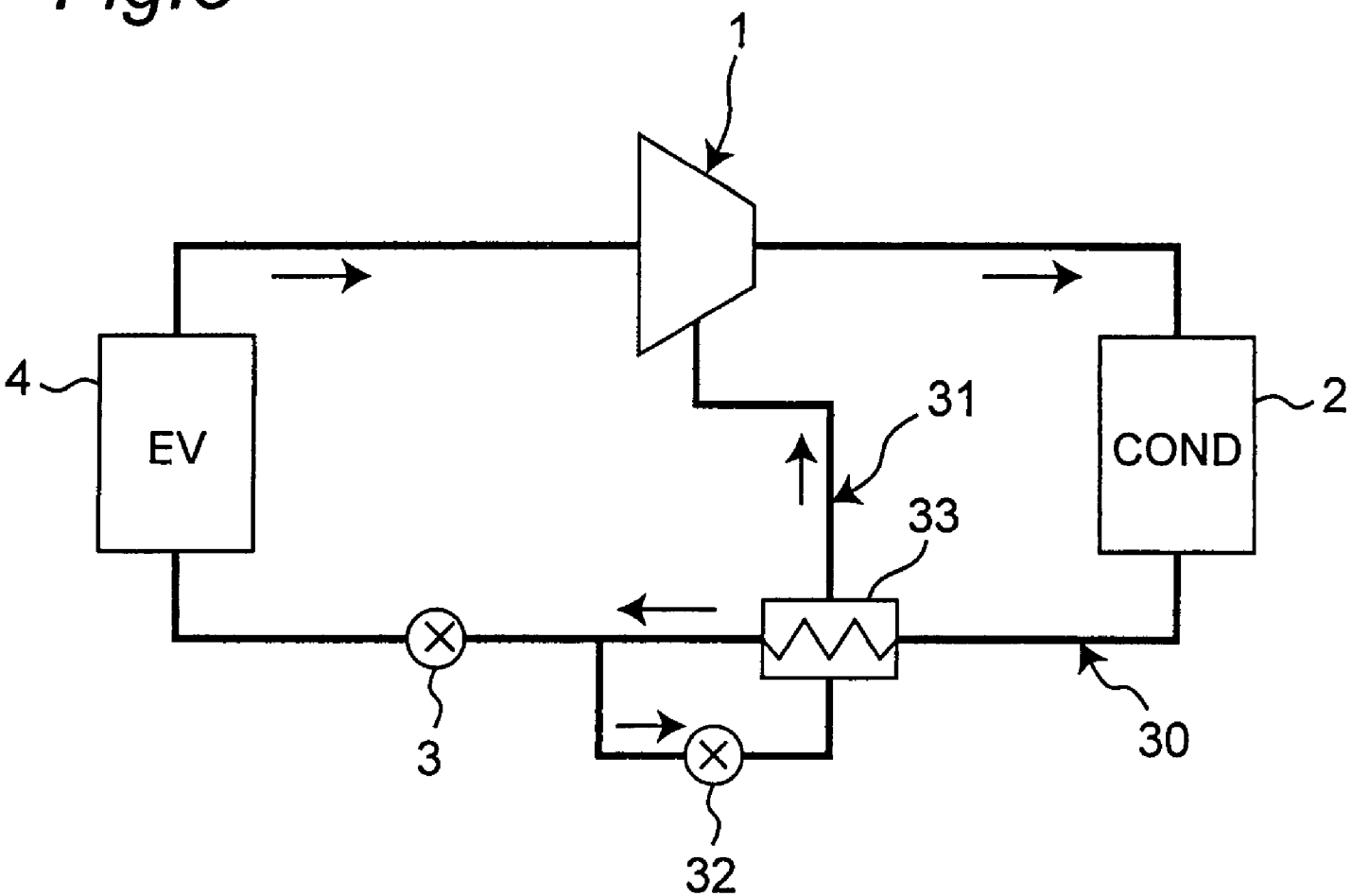
FIG. 5 is a simplified block diagram showing a freezer in one embodiment of the present invention.

Next, a freezer according to one embodiment of the present invention is shown in FIG. 5. In the freezer, the screw compressor 1 in the present invention, a condenser 2, an expansion section 3 and an evaporator 4 are connected in sequence like a ring so as to form a refrigeration cycle with use of a refrigerant. Expansion valves and capillary tubes, for example, are used as the expansion section 3.

Description will be given of the refrigeration cycle. A vapor-phase refrigerant discharged in the screw compressor 1 is deprived of heat by the condenser 2 and attains a liquid phase. This liquid-phase refrigerant is decompressed by the expansion section 3 and attains two phases of vapor and liquid. Then, the two-phase refrigerant (humid gas) is given heat in the evaporator 4 and attains a vapor phase. This vapor-phase refrigerant is sucked and pressurized in the screw compressor 1 before being discharged again by the screw compressor 1.

The freezer has a sidestream path 31 which diverges from a mainstream path 30 located between the condenser 2 and the expansion section 3, and communicates with the economizer port 12 in the screw compressor 1. The mainstream path 30 and the sidestream path 31 are formed from pipes.

On the sidestream path 31, there are provided a supercooling expansion section 32 and a supercooling heat exchanger 33 for executing heat exchange between the refrigerant on the outlet side of the supercooling expansion section 32 and the refrigerant in the mainstream path 30. Expansion valves and capillary tubes, for example, are used as the supercooling expansion section 32.

In FIG. 5, the sidestream path 31 diverges from the mainstream path 30 on the downstream side of the supercooling heat exchanger 33. However, the sidestream path 31 may diverge from the mainstream path 30 on the upstream side of the supercooling heat exchanger 33.

Description is now given of the operation of the supercooling heat exchanger 33. A liquid-phase refrigerant coming from the condenser 2 into the mainstream path 30 is distributed to the sidestream path 31. The liquid-phase refrigerant in the sidestream path 31 is decompressed in the supercooling expansion section 32 to be a two-phase refrigerant formed of vapor and liquid. This two-phase refrigerant draws heat from the liquid-phase refrigerant in the mainstream path 30 via the supercooling heat exchanger 33 to be a vapor-phase refrigerant. This vapor-phase refrigerant is sucked by the screw compressor 1. In this case, the liquid-phase refrigerant in the mainstream path 30 is cooled via the supercooling heat exchanger 33.

According to the thus-structured freezer, the screw compressor 1 of the invention increases the amount of the refrigerant jetted from the sidestream path 31 (the supercooling heat exchanger 33), which makes it possible to enhance the efficiency of the supercooling heat exchanger 33.

Thereby, the degree of liquid supercooling (SC) of the refrigerant immediately before the expansion section 32 can be increased and therefore the refrigeration capacity can be enhanced. Moreover, downsizing of the supercooling heat exchanger 33 allows reduction in product size and cost.

Figure 6:
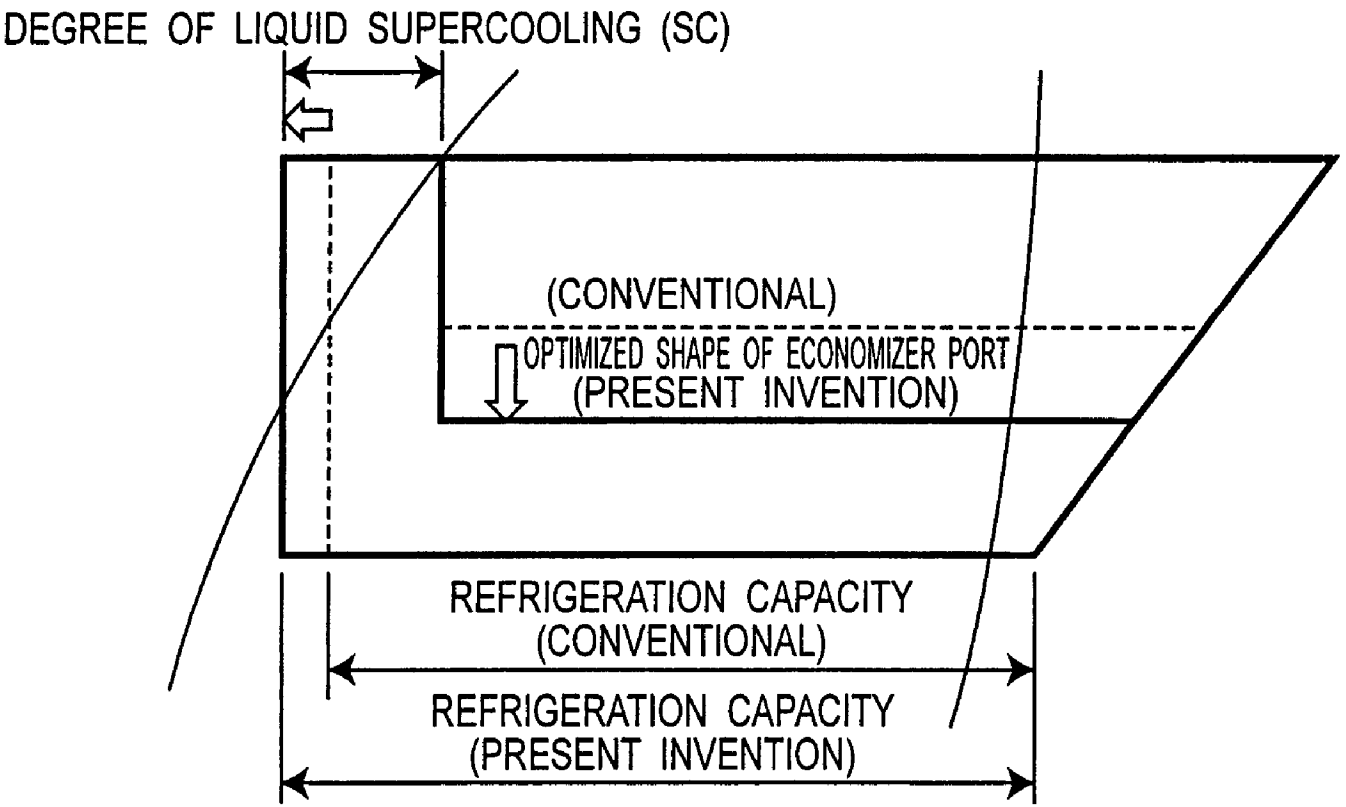
FIG. 6 is a Ph diagram showing the comparison between a freezer in the present invention and a conventional freezer.
Figure 7:
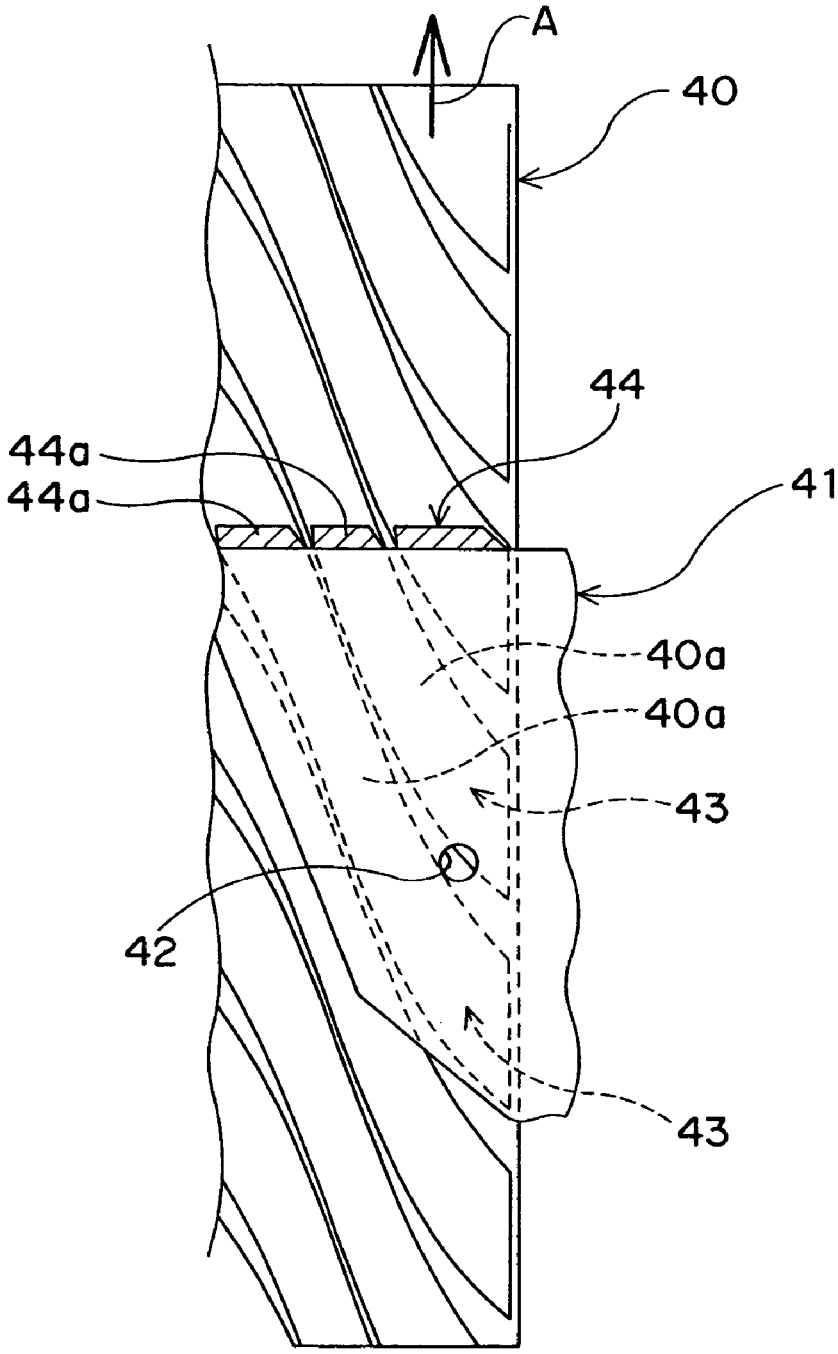
Fig.7 PRIOR ART
FIG. 7 is a simplified plane development view showing a conventional screw compressor.

Specifically, since the freezer of the present invention shown by thick lines in FIG. 6 is optimized in shape and layout of the economizer port 12, the freezer makes the degree of liquid supercooling (SC) larger than the conventional freezer shown by dotted lines, as shown in FIG. 6. Thereby, the refrigeration capacity is enhanced.

It should be noted that the present invention is not limited to the above-stated embodiments, and that design may be changed within the scope of the present invention. For example, the present invention may apply to a twin screw compressor, as a screw compressor of the invention, which forms a compression chamber by engagement of a pair of male and female rotors, besides the single screw compressor.

What is claimed is:

1. A screw compressor comprising:

a screw rotor;

a cylinder for housing the screw rotor; and an economizer port provided in the cylinder and communicating with a compression chamber formed between the screw rotor and an inner face of the cylinder, the economizer port being configured and arranged to jet a refrigerant into the compression chamber before closing the compression chamber, the compression chamber being closed before the refrigerant jetted from the economizer port leaks to a low pressure side of the screw rotor, and the economizer port being formed along a length direction of a vane of the screw rotor, the economizer port having a maximum width measured along a width direction of the vane and a maximum length measured along the length direction of the vane with the maximum length of the economizer port being larger than the maximum width of the economizer port, with the economizer port being formed by a single elongated hole as viewed along a center axis of the hole.

2. A screw compressor comprising:

a screw rotor;

a cylinder for housing the screw rotor; and an economizer port provided in the cylinder and communicating with a compression chamber formed between the screw rotor and an inner face of the cylinder, the economizer port being configured and arranged to jet a refrigerant into the compression chamber before closing the compression chamber, the economizer port being formed by a plurality of holes arranged along a lengthwise direction of a common vane of the screw rotor, the compression chamber being closed before the refrigerant jetted from the economizer port leaks to a low pressure side of the screw rotor, and the economizer port having a maximum width measured along a width direction of the common vane and a maximum length measured along the lengthwise direction of the common vane with the maximum length of the economizer port being larger than the maximum width of the economizer port, with the economizer port being formed by a single elongated hole as viewed along a center axis of the hole.

3. The screw compressor according to claim 2, wherein the maximum width of the economizer port being no larger than a vane width of the common vane at a location where the economizer port crosses the common vane such that the economizer port can be closed by the vane, with the maximum width and the vane width being measured perpendicularly to the lengthwise direction of the common vane.

4. A screw compressor comprising:

a screw rotor;

a cylinder for housing the screw rotor; and an economizer port provided in the cylinder and communicating with a compression chamber formed between the screw rotor and an inner face of the cylinder, the economizer port being configured and arranged to jet a refrigerant into the compression chamber before closing the compression chamber, the economizer port being formed by a plurality of holes arranged along a lengthwise direction of a common vane of the screw rotor, the compression chamber being closed before the refrigerant jetted from the economizer port leaks to a low pressure side of the screw rotor, the economizer port is formed along a length direction of a vane of the screw rotor, the economizer port has a maximum width no larger than a vane width of the vane at a location where the economizer port crosses the vane such that the economizer port can be closed by the vane, with the maximum width and the vane width being measured perpendicularly to the length direction of the common vane, and the economizer port having a maximum length measured along the length direction of the vane with the maximum length of the economizer port being larger than the maximum width of the economizer port, with the economizer port being formed by a single elongated hole as viewed along a center axis of the hole.

5. A screw compressor comprising:

a screw rotor;

a cylinder for housing the screw rotor; and an economizer port provided in the cylinder and communicating with a compression chamber formed between the screw rotor and an inner face of the cylinder, the economizer port being configured and arranged to jet a refrigerant into the compression chamber before closing the compression chamber, the economizer port being formed by a plurality of holes arranged along a lengthwise direction of a common vane of the screw rotor, the compression chamber being closed before the refrigerant jetted from the economizer port leaks to a low pressure side of the screw rotor, and the economizer port being formed along a length direction of a vane of the screw rotor, the economizer port having a maximum width measured along a width direction of the vane and a maximum length measured along the length direction of the vane with the maximum length of the economizer port being larger than the maximum width of the economizer port, with the economizer port being formed by a single elongated hole as viewed along a center axis of the hole.

6. A screw compressor comprising:

a screw rotor;

a cylinder for housing the screw rotor; and an economizer port provided in the cylinder and communicating with a compression chamber formed between the screw rotor and an inner face of the cylinder, the economizer port being configured and arranged to jet a refrigerant into the compression chamber before closing the compression chamber, the economizer port being formed along a length direction of a vane of the screw rotor and having a center line perpendicular to the length direction that is equally spaced from opposite ends of the economizer port, the compression chamber being closed before the refrigerant jetted from the economizer port leaks to a low pressure side of the screw rotor, a width of the vane of the screw rotor becoming gradually larger from a central section of the screw rotor toward at least one end side, a first maximum width of the economizer port on a side of the centerline toward the end side where the width of the vane is larger being larger than a second maximum width of the economizer port on an opposite side of the centerline, with the first and second maximum widths being measured perpendicularly to the length direction of the vane, and the economizer port having a maximum length measured along the length direction of the vane with the maximum length of the economizer port being larger than the maximum width of the economizer port, with the economizer port being formed by a single elongated hole as viewed along a center axis of the hole.

* * * * *